US008557086B2

(12) United States Patent
Eronen et al.

(10) Patent No.: US 8,557,086 B2
(45) Date of Patent: Oct. 15, 2013

(54) VACUUM EQUIPMENT FOR A FIBER WEB MACHINE AND A FIBER WEB MACHINE PROVIDED WITH VACUUM EQUIPMENT

(75) Inventors: Ville H. Eronen, Jyväskylä (FI); Miikka Hyvärinen, Jyväskylä (FI); Veli-Pekka Tarkiainen, Muurame (FI); Jyrki Savela, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 13/643,263

(22) PCT Filed: Apr. 14, 2011

(86) PCT No.: PCT/FI2011/050330

§ 371 (c)(1), (2), (4) Date: Oct. 24, 2012

(87) PCT Pub. No.: WO2011/135168

PCT Pub. Date: Nov. 3, 2011

(65) Prior Publication Data

US 2013/0042988 A1 Feb. 21, 2013

(30) Foreign Application Priority Data

Apr. 26, 2010 (FI) ..... 20105453

(51) Int. Cl.
*D21F 1/48* (2006.01)

(52) U.S. Cl.
USPC ..... 162/374

(58) Field of Classification Search
USPC ..... 162/374, 279, 352, 363, 366, 300
See application file for complete search history.

(56) References Cited

U.S. PATENT DOCUMENTS 1,534,854 A * 4/1925 Lewis ..... 162/374
2,006,519 A * 7/1935 Standley ..... 162/372

(Continued)

FOREIGN PATENT DOCUMENTS

FR 1482178 A 8/1967
WO 2009135992 A1 11/2009
WO 2011135168 A1 11/2011

OTHER PUBLICATIONS

International Search Report for PCT/FI2011/050330 dated Jul. 6, 2011.

(Continued)

*Primary Examiner* — Mark Halpern
(74) *Attorney, Agent, or Firm* — Stiennon & Stiennon

(57) ABSTRACT

The invention relates to vacuum equipment for a fiber web machine. The vacuum equipment includes a frame (13) arranged to be supported to the fiber web machine. The vacuum equipment also includes a wearing construction (15) adapted to the frame (13) and arranged partially open on the surface by means of several openings (14) for extending a vacuum effect out from within the frame (13) and further to a fabric (16) included in the fiber web machine and set in contact with the wearing construction (15). The wearing construction (15) is a plate construction (17), the raw material thickness s of which is equal to or smaller than the distance x between the opposite edges (18, 19) defining the opening (14). The invention also relates to a fiber web machine provided with vacuum equipment.

20 Claims, 5 Drawing Sheets

(56) References Cited

U.S. PATENT DOCUMENTS

| | | | | | |
|---|---|---|---|---|---|
| 2,487,202 | A | * | 11/1949 | Wadleigh | 162/374 |
| 2,543,870 | A | * | 3/1951 | Robbins | 162/374 |
| 2,618,206 | A | * | 11/1952 | Van Ryzin | 162/374 |
| 2,712,776 | A | * | 7/1955 | Wagenknecht | 162/374 |
| 2,934,143 | A | * | 4/1960 | Hornbostel | 162/351 |
| 3,102,066 | A | * | 8/1963 | Justus | 162/209 |
| 3,352,749 | A | | 11/1967 | Perry | |
| 5,147,508 | A | | 9/1992 | Sweet | |

OTHER PUBLICATIONS

Written Opinion of the International Searching Authority for PCT/FI2011/050330 dated Jul. 6, 2011.

* cited by examiner

VACUUM EQUIPMENT FOR A FIBER WEB MACHINE AND A FIBER WEB MACHINE PROVIDED WITH VACUUM EQUIPMENT

CROSS REFERENCES TO RELATED APPLICATIONS

This application is a U.S. national stage application of International App. No. PCT/FI2011/050330, filed Apr. 14, 2011, the disclosure of which is incorporated by reference herein and claims priority on Finnish App. No. 20105453, filed Apr. 26, 2010.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to vacuum equipment for a fiber web machine, the vacuum equipment including a frame arranged to be supported to the fiber web machine, and a wearing construction adapted to the frame and arranged partially open on the surface by means of several openings for extending a vacuum effect out from within the frame and further to a fabric included in the fiber web machine and adapted in contact with the wearing construction. The invention also relates to a fiber web machine provided with vacuum equipment.

Vacuum apparatuses are used in a fiber web machine for various purposes. Most common of these are so called vacuum boxes which are used to remove water from the web produced for increasing the dry content. One vacuum box application is referred to as a felt suction box, which is used in the press section of a fiber web machine. In the press section, it is also possible to use a so called transfer suction box, which ensures detachment of the web at a correct time when transferred from a fabric to another. Furthermore, vacuum suction boxes are used in fabric re-conditioners to absorb the cleaning liquid sprayed to the fabric together with the impurities. Vacuum equipment are also present in the forming section. In all applications the vacuum equipment includes a frame extending from one side of the fiber web machine to the other, over the entire fabric width. The frame additionally includes a wearing construction set in contact with the fabric. Furthermore, the wearing construction is open for its surface for extending the vacuum effect generated within the frame to the fabric. It is strived to adapt the wearing construction in such a way that it is resistant in use without excessively wearing the fabric and without wearing itself.

The wearing construction can be formed of several successive blades adapted at a distance from each other. That is, openings are formed by the slits between the blades. Conventionally, the wearing parts of the blades are made of a ceramic material, whereby the construction becomes expensive and sensitive to damage. During use, the fabric, or a felt in case of a felt suction box, is drawn to the slit due to the suction effect generated by the vacuum. This causes friction, which further increases the energy consumption. In addition, the fabric wears disadvantageously fast. For example, with two slits of 15 mm, the efficient dewatering area achieved is about 300 $cm^2$ per length meter. Here the term 'length' refers to the dimension of the vacuum equipment in the transverse direction of the fiber web machine. In practice, it is impossible to increase the slit width due to the fabric wear and increased energy consumption. A sufficient dewatering efficiency has required high vacuum levels, which leads to high operating costs.

Attempts have been made to replace the blades with a wearing construction in which the openings are composed of several holes. Such holes have been machined to a thick solid material. In this case the wearing construction becomes expensive, but a larger dewatering area is achieved with perforated holes compared to blades, without increased felt constriction. As the holes are relatively small, fabric constriction can be avoided. The dewatering time also increases, which makes dewatering more efficient. At the same time, low vacuum levels can be used, which reduces fabric constriction. Then the friction is low resulting in slow fabric wear and a reduced effect of the vacuum equipment on the driving power. In practice, one vacuum apparatus equipped with perforated holes can remove more water than two apparatuses with slit openings. However, a machined wearing construction is expensive, and such long, yet small, holes get gradually plugged. In practice, the holes must be regularly cleaned, which increases production breaks. In addition, changing a blade construction into a hole construction is difficult, often even impossible. Fabric wear may even increase in some cases.

SUMMARY OF THE INVENTION

The object of the invention is to provide novel vacuum equipment for a fiber web machine, the equipment being more efficient than before but less expensive to manufacture and use. Another object is to provide a novel fiber web machine provided with vacuum equipment, the production process thereof being more efficient and reliable than before without production breaks. The characteristic features of this vacuum equipment for a fiber web machine and the fiber web machine provided with vacuum equipment according to the invention are that the wearing construction is a plate construction, the raw material thickness s thereof being equal to or smaller than the distance x defining the opposite edges of the opening. Firstly, the sheet material is inexpensive and can be easily machined using simple equipment and methods. Secondly, with the dimensioning according to the invention, the width of the opening can be made larger than its depth such that plugging of the opening is impossible and the pressure loss of the hole is small. Thus the dewatering efficiency remains unchanged and maintenance shutdowns due to plugging can be avoided. Surprisingly, it was discovered that the dewatering efficiency of the vacuum equipment had also increased such that the same dewatering amount could be achieved with a lower vacuum than before. The plate construction is light in weight, yet rigid, and completely new properties can be incorporated therein. As a result, a larger efficient dewatering area is achieved with low friction. Thus, the fabric wear is avoided and the power requirement is low. The novel wearing construction can also be retrofitted to existing vacuum equipment and, due to the lightness, it can be installed in place during the shutdown using man power without the need of a bridge crane, the limited capacity of which has extended the shutdown time.

The invention is described below in detail by making reference to the enclosed drawings which illustrate some of the embodiments of the invention.

DESCRIPTION OF THE PREFERRED EMBODIMENTS

Figure 1:
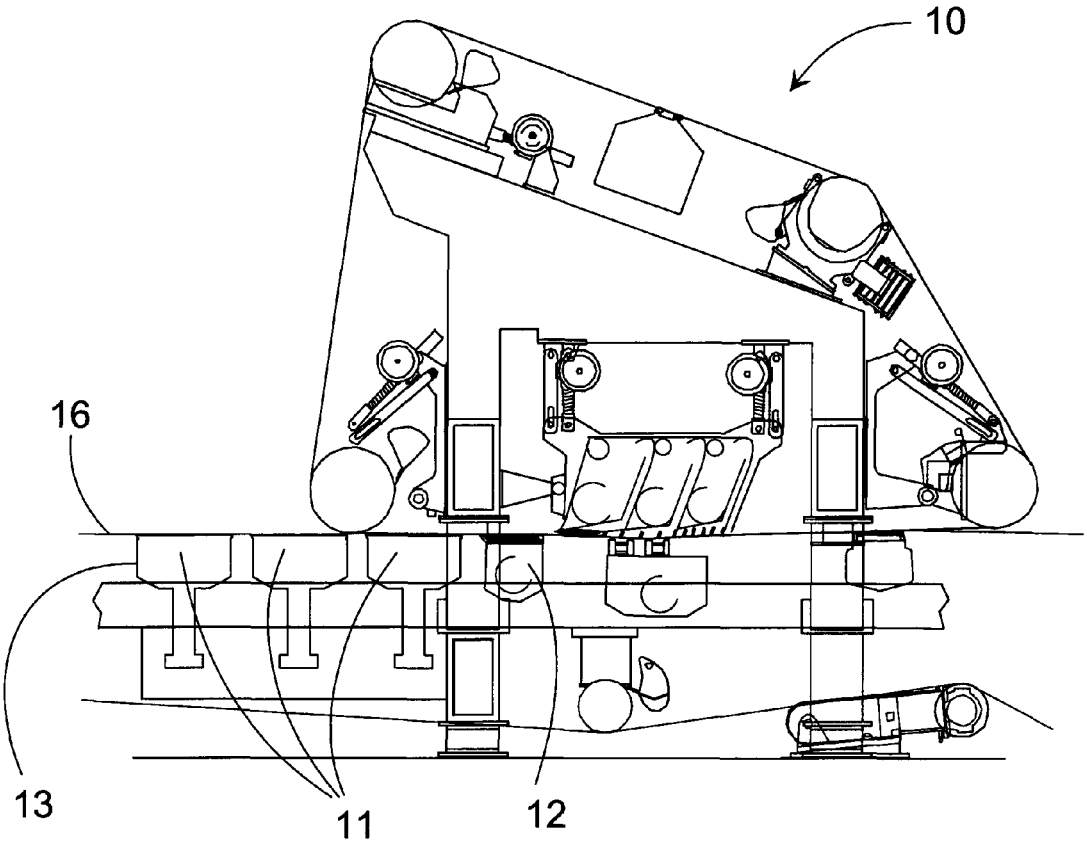
FIG. 1 shows vacuum equipment according to the invention adapted in the forming section of a fiber web machine.

FIG. 1 illustrates possible applications of the vacuum equipment according to the invention. For example, the forming section 10 of a fiber web machine shown here is provided with various vacuum apparatuses in different positions. The fiber web machine may be, for example, a paper machine or a board machine or another machine suitable for producing a fiber web. The vacuum equipment can be, for example, a low-vacuum suction box 11 or a high-vacuum suction box 12. In the press section following the forming section, the vacuum equipment can be, for example, a felt suction box or a transfer suction box (not shown).

Figure 2:
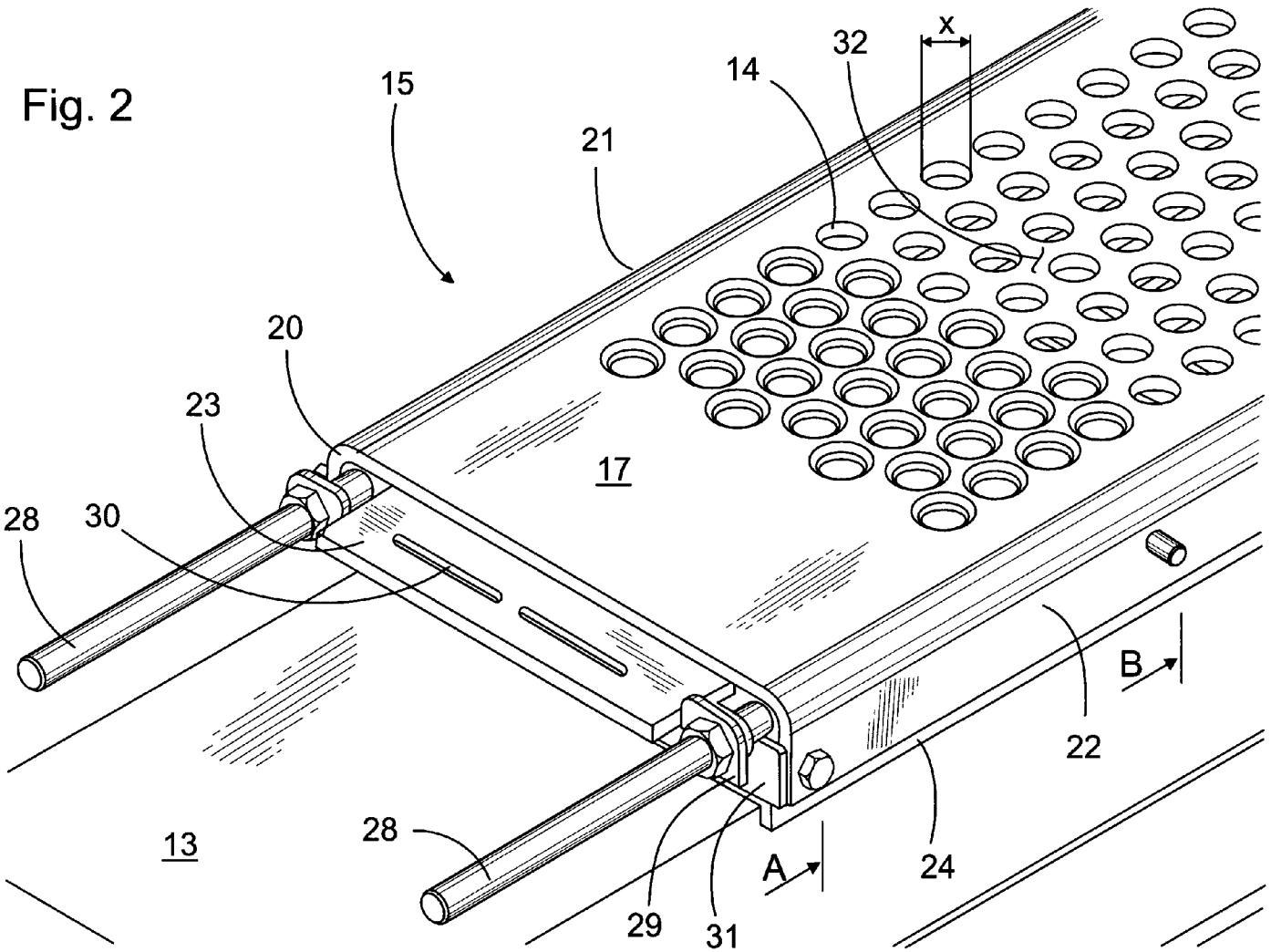
FIG. 2 shows one end of a wearing construction of vacuum equipment according to the invention.

The vacuum equipment is thus meant particularly for a fiber web machine. Water is removed from the web produced in a fiber web machine in several different ways. Vacuum is also utilized in many positions. Generally, the vacuum equipment includes a frame 13 arranged to be supported to the fiber web machine. The frame usually extends over the entire fabric width and is supported to the frames of the fiber web machine at its ends. In addition, as shown in FIG. 2, the vacuum equipment includes a wearing construction 15 adapted to the frame 13 and arranged partially open on the surface by means of several openings 14. The wearing construction 15 is also referred to as a cover. The wearing construction 15 is in contact with the fabric and must be resistant to the chafing wear while the fabric slides past it without interruption. Due to the open surface, the vacuum effect can be extended from within the frame 13 to the fabric 16 included in the fiber web machine and set in contact with the wearing construction 15. The frame is usually a box that is open from one side and closed with the wearing construction 15. A vacuum is arranged inside the box using, for example, a vacuum pump or a blower. Through the openings in the wearing construction the vacuum effect extends to the fabric passing by at a high speed to absorb water from the fabric. The box is also provided with discharge connections for removing the water collected.

According to the invention, the wearing construction 15 is a plate construction 17. The sheet material is an inexpensive raw material and uncomplicated to machine. Moreover, the finished wearing construction is light in weight. According to the invention, the size of the opening is also decidedly considered in dimensioning. The plate construction and the openings are so adapted that the raw material thickness s of the sheet construction is equal to or smaller than the distance x between the opposite edges 18 and 19 defining the opening 14. In other words, the size of the opening is equal or larger than the raw material thickness of the plate construction. Such surprising dimensioning completely eliminates the harmful plugging problem that was present earlier. Now accumulation of loose material in the opening is prevented and thus plugging of the opening is impossible.

Figure 3A:
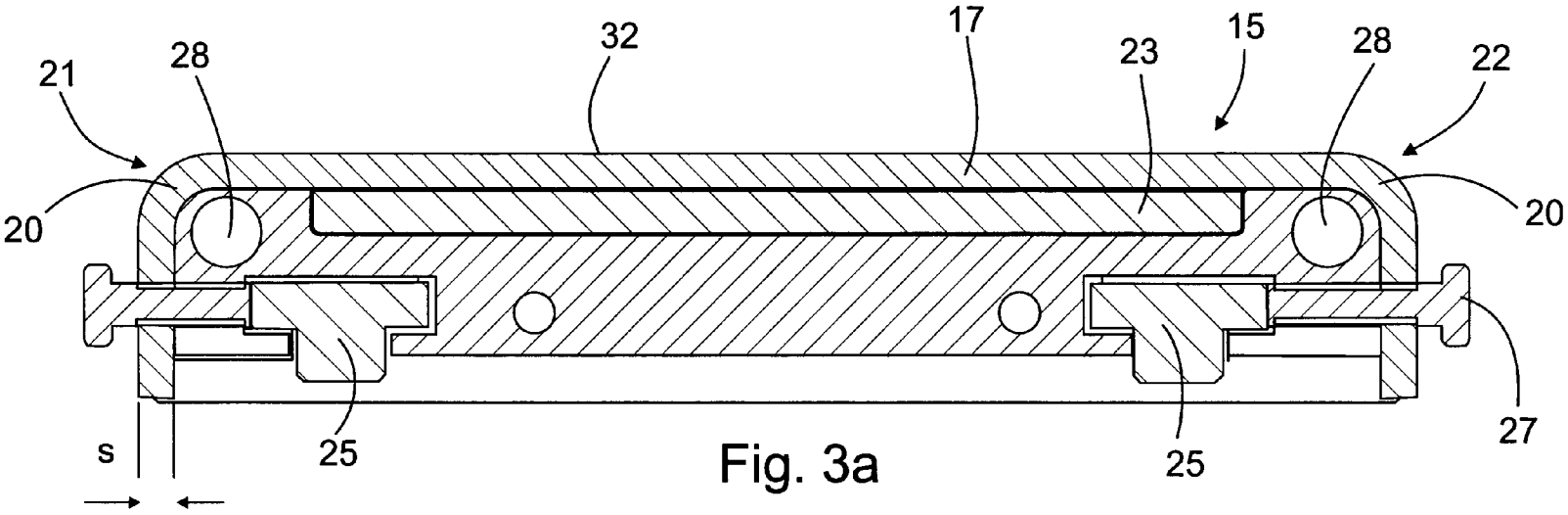
FIG. 3*a* shows a cross-section of the wearing construction of FIG. 2 relative to plane A.
Figure 3B:
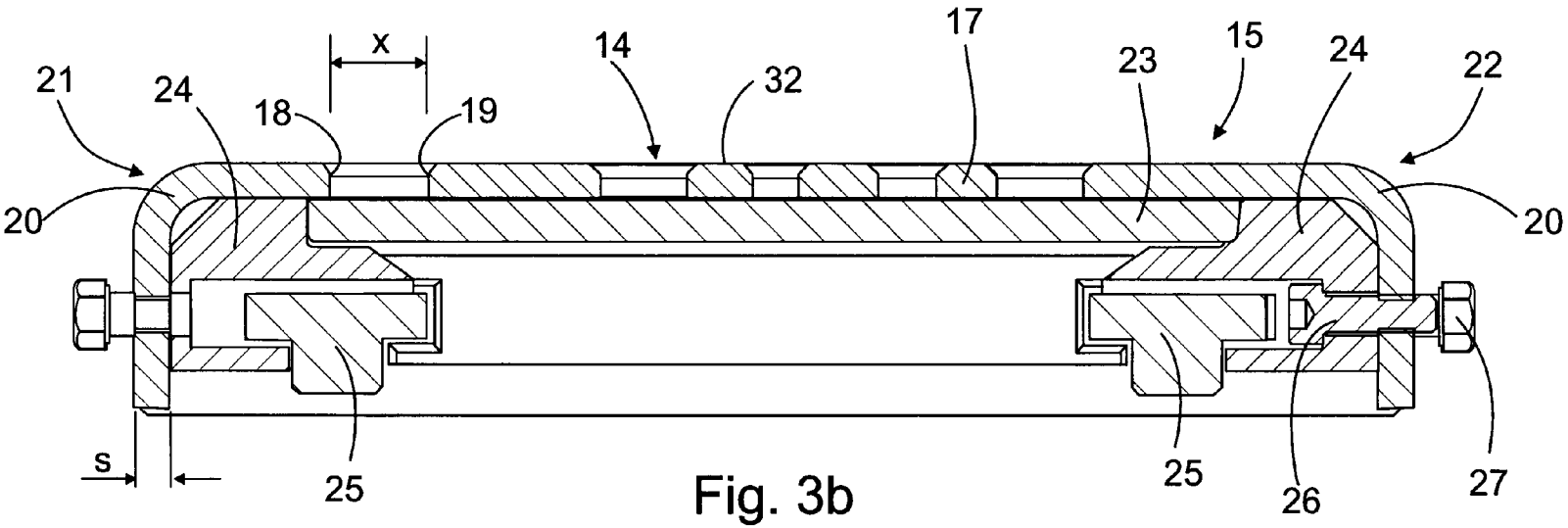
FIG. 3*b* shows a cross-section of the wearing construction of FIG. 2 relative to plane B.

The raw material thickness can vary in different applications. However, the plate construction 17 is advantageously sheet metal with a raw material thickness of 2-10 mm, more advantageously 4-6 mm. Several advantages are achieved by using sheet metal. Firstly, the wearing construction becomes light in weight. Secondly, the openings are easy to machine with laser or plasma cutting or by punching, for example. Laser cutting, in particular, is precisely controllable and can be made completely automatic. The distance x between the opposite edges 18 and 19 defining the opening 14 is advantageously 10-25 mm, depending on the design of the opening. Furthermore, the cutting result is neat and the sheet component is often ready for use without further machining. In addition, present equipment enables manufacturing long components as well. Thus continuous components of several meters, even ten meters, can be produced without seams. In fact, the plate construction is a continuous component at least in the cross direction. In other words, the plate construction is seamless at least in the travel direction of the fabric, which reduces the fabric wear. If necessary, the plate construction is formed of two or more sheet components which are adapted end to end in the finished vacuum equipment. The plate construction comprises a planar sliding surface 32 along which the fabric travels. As shown in FIG. 3*b*, the angle between the opposite edges 18 and/or 19 defining the opening 14 and the sliding surface 32 is advantageously rounded for reducing friction and preventing wearing of the coating.

With suitable bracketing, even a planar plate construction made of sheet metal resists well the stresses of the process. Advantageously, the plate construction 17 includes at least one bend 20 which remarkably stiffens the plate construction. Furthermore, bending, as well as edging, is an inexpensive and precise method that is well suitable for the sheet metal material. FIGS. 2, 3*a* and 3*b* show a wearing construction, planar for its sliding surface 32, having its leading edge 21 and trailing edge 22 bent by 90°. Thus a simple, yet rigid U-shape plate construction is formed. With a suitable curvature radius of the bend, roundings are naturally formed in the leading and trailing edge, which reduces the fabric wear and allows small position errors for the frame. Bending can be performed before or after forming the openings. With bendings, sufficient strength is achieved with a material thickness of 5 mm, for example, in which case the wearing construction is self-supporting.

Figures 5A, 5B, 5C, 5D:
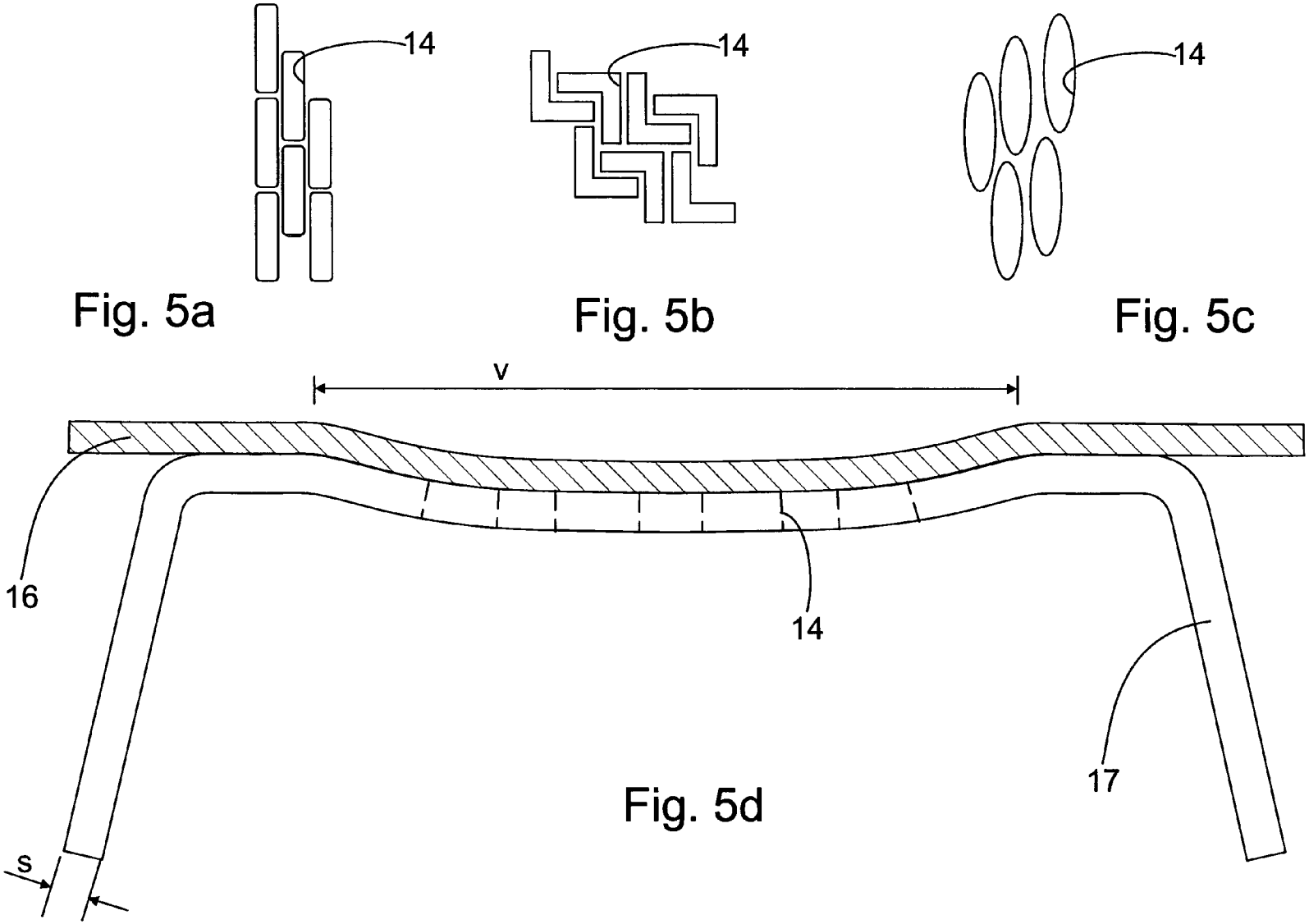
FIGS. 5*a-c* show alternative designs for the opening.
FIG. 5*d* shows the basic drawing of a second embodiment of the wearing construction according to the invention.

The planar vacuum equipment according to the invention has been tested with good results. However, completely new properties can be added to the plate construction. In the embodiment of FIG. 5*d*, the wearing construction 15 is concave, the concavity center line being in the width direction of the frame. Thus the planar areas of the leading and trailing edges receive the highest chafing stresses. In addition, the openings 14 are adapted to the concave portion v of the wearing construction 15 so that the wearing effect of the openings on the fabric is as small as possible. In practice, the fabric tension is involved in outweighing the force produced by the vacuum. Thus the support force becomes reduced in the open surface area. At the same time, the fabric travels in the plane of the leading and trailing edges when the vacuum level is zero. Otherwise the degree of concavity can be freely determined. With the solution described above, a pan-like construction is achieved thus avoiding suction losses caused by leaks. Naturally, with a concave design, smaller friction is also achieved compared to a planar wearing construction. At the same time, wearing of the hard coating becomes equalized as the load is transferred from the area of the small carrying surface to the area of the large carrying surface, compared to a straight solution.

The plate construction according to the invention can be manufactured, for example, from stainless or acid-proof steel which is corrosion-resistant but easily machinable. The wear resistance is achieved with the hard coating mentioned above. For example, thermal spraying provides a smooth and resistant hard coating which is ceramic or cera-metallic. For example, oxides based on Al, Cr, Ti, Zr or Si or their alloys, or carbides based on W, Cr, V, Ti or Si and their alloys bound with a metal matrix, can be used in spraying. The latter is also referred to as a kermet coating which is a ceramic metal composite coating. The wearing construction is coated after the openings have been machined. The coating is additionally finished with the diamond brushing technique, for example, which provides extremely smooth roundings for the openings cost-efficiently. Smooth roundings remarkably reduce the fabric wear. Brushing can be performed with a cup brush, for example, having 15-25% by volume of diamond particles in the bristles. The surface roughness Ra of a hard coating finished with this method is below 0.5 μm, even below 0.1 μm.

In the embodiment shown in FIG. 2, a round hole is used as the opening. The holes are positioned in imbricately arranged inclined rows thus avoiding web marking and an uneven fabric moisture profile. At the same time, a large open surface area is achieved. The hole diameter is advantageously 10-20 mm. A round hole is easy to machine and finish. However, the perforation can be made with a freely selectable design. Various designs for openings are shown in FIGS. 5*a*-*c*. FIG. 5*a* illustrates openings that are rectangular for their main design, adapted to two imbricately arranged rows. In FIG. 5*b*, the openings have an L shape with branches of equal length. In addition, the openings are turned relative to each other such that the lands between the openings remain constant in dimension. FIG. 5*c* shows elongated, oval-shaped openings, arranged in inclined rows. All these three opening designs have roundings at the edges. In FIG. 2, the edge-most holes are additionally provided with counterbores . Thus, particularly wearing of the fabric edges is avoided. Counterbores are advantageously used essentially in all holes to reduce the fabric wear. The counterbores are advantageously rounded for minimizing the fabric wear. The same figure also shows an adjustable end seal 23 which can be used to define the area of the open surface by changing the position thereof. Similar end seals are provided at both ends of the vacuum device.

Figure 4:
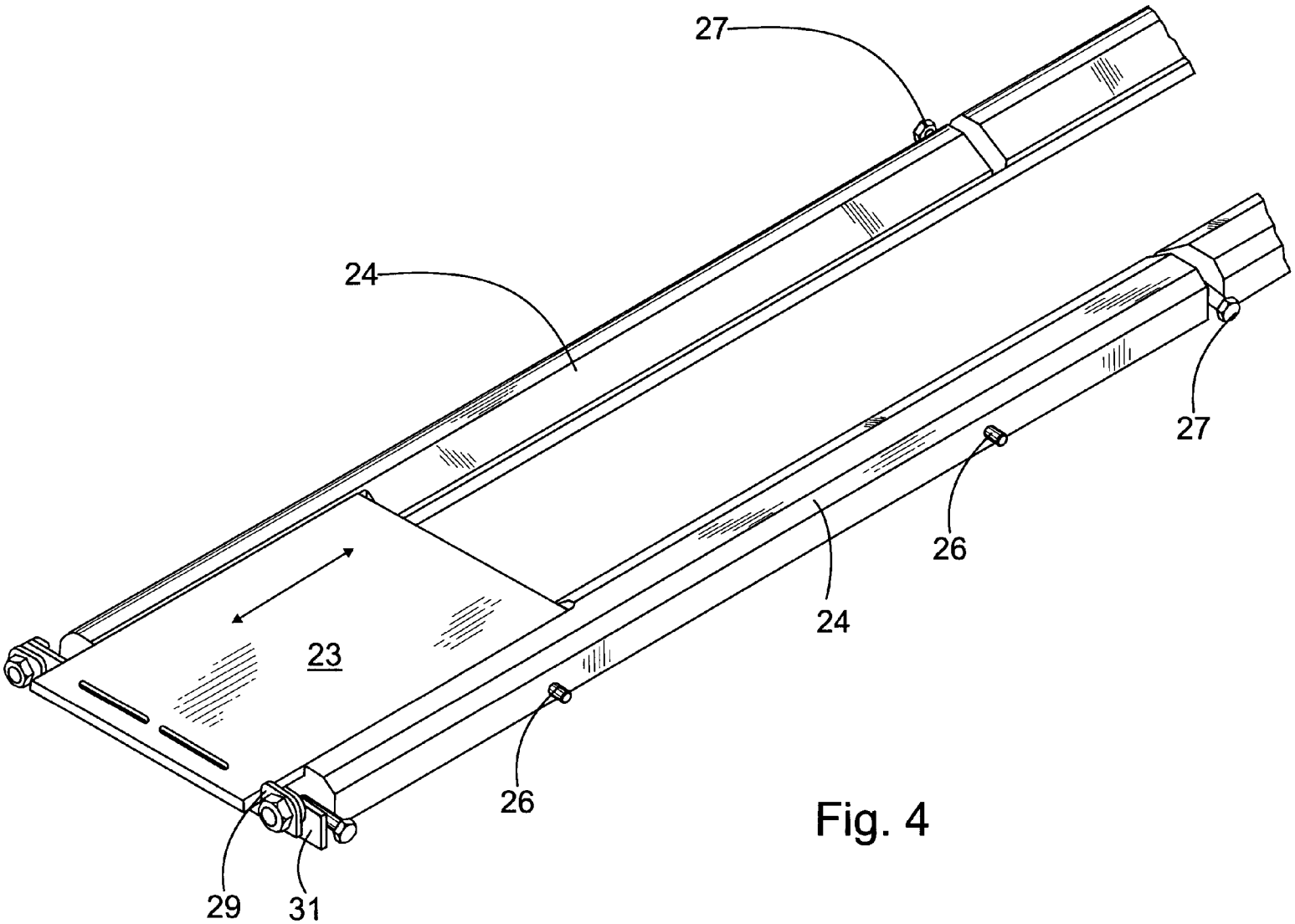
FIG. 4 shows fitting components according to the invention for fastening a wearing component.

At the simplest, the wearing construction is fastened to the frame with bolts, for example. Thus a very rigid box-like construction is formed. However, FIGS. 2-4 show an embodiment which is suitable for existing vacuum equipment. FIG. 4 illustrates fitting components 24 included in the vacuum equipment for fastening the wearing construction 15 to existing T rails 25. In this way the wearing construction can be fastened without separate modification works. The fitting components are profiled according to the wearing construction and, additionally, they can be directly fitted to the outer T rails 25 by pushing. Here the fitting components 24 are fastened to the wearing construction 15 before installation with internal screws 26 (FIG. 3*b*). After this, the wearing construction 15 together with the fitting components 24 is pushed to the T rail 25 and the fastening is locked clearance-free with external bolts 27 (FIG. 3*a*).

In the embodiment shown, bracketing and adjustment of the end seal 23 is also incorporated in the fitting components. Adapted as an extension to both fitting components 24, there are threaded bars 28 with a flat bar bracket 29 supported therebetween. The protrusions 30 in the flat bar bracket 29 lock to the openings in the end seal 23 such that the end seal moves for a corresponding distance by moving the flat bar bracket. The end seal is partially supported by a supporting flat bar 31 which is fastened to the fitting components 24. The supporting flat bar also binds the wearing construction in the longitudinal direction. The flat bar bracket is locked with nuts adapted to the threaded bars.

The vacuum equipment according to the invention provides an advantageous and efficient fiber web machine. Supported to the fiber web machine, there is a frame 13 to which a wearing construction 15 arranged partially open on the surface by means of several openings 14 is adapted for extending the vacuum effect out from within the frame 13 and further to the fabric 16 included in the fiber web machine. According to the invention, the wearing construction 15 is thus a plate construction 17, the raw material thickness s of which is equal to or smaller than the distance x between the opposite edges 18 and 19 defining the opening 14.

Three different vacuum apparatuses otherwise similar to each other except for a different wearing construction have been compared in tests. The first apparatus included two successive vacuum apparatuses both equipped with a four-slit blade cover. The second one had a perforated cover according to the invention followed by a two-slit blade cover. The third one had only a perforated cover according to the invention. The trial run was performed with three different air volumes, for three different vacuum apparatuses each with the same orientation. With the mere perforated cover, more efficient dewatering was achieved with the same air volume and lower friction than before compared to the other two designs. The felt moisture, for example, was as much as over 200 g/m$^2$ lower than that of the others. At the same time, the water removal was as much as 0.5 l/s higher than that of the others. Correspondingly, the power consumption of the vacuum equipment dropped as much as over 20 kW, and a vacuum level by over 20 kPa higher was achieved with the same air volume.

The wearing construction according to the invention is bent from a sheet material and perforated as well as hard coated and finished. With a suitable dimensioning and design of the openings, efficient dewatering is achieved with a lower energy consumption and slower rate of fabric wear. The wearing construction can be installed in existing vacuum apparatuses using plastic fitting components or, alternatively, with a bolted connection. Thus upgrading of the wearing construction is a small investment. The wearing construction is economical to manufacture particularly from sheet metal. At the same time, traditional problems, such as plugging of openings, can be completely avoided. In addition, a sheet metal construction also enables a concave surface profile which provides additional benefits in terms of the fabric wear and power consumption. Overall, the vacuum equipment according to the invention is efficient, economic and energy-saving.

The invention claimed is:

1. Vacuum equipment for a fiber web machine having a fabric moveable to define a machine direction, comprising:

a frame arranged to be supported on the fiber web machine, the frame having an interior forming a source of vacuum;

a cover mounted to the frame, the cover separating the fabric from the frame interior forming the source of vacuum, the cover having a wear surface and having portions defining a plurality of openings, said openings being defined by opposite edges, the opposite edges defining a distance x in the machine direction therebetween, the openings in the cover for extending a vacuum effect from the interior;

wherein the cover wear surface is in contact with the fabric; and wherein the cover is of a plate construction having a raw material thickness s between the fabric and the frame interior forming the source of vacuum, wherein the thickness s is less than or equal to the distance x.

2. The apparatus of claim 1 wherein the plate construction is sheet metal the raw material thickness of which is 2-10 mm.

3. The apparatus of claim 2 wherein the plate construction is sheet metal the raw material thickness of which is 4-6 mm.

4. The apparatus of claim 1 wherein the distance x is 10-25mm.

5. The apparatus of claim 1 wherein the cover defines a leading edge and a trailing edge with respect to movement of the fabric over the cover, and wherein the plate construction includes at least one bend at the leading edge or at the trailing edge.

6. The apparatus of claim 1 wherein the cover has a concave portion defining a centerline which extends in a cross direction with respect to movement of the fabric over the cover.

7. The apparatus of claim 1 wherein the openings define a leading edge of the openings and a trailing edge of the openings with respect to movement of the fabric over the cover and wherein the cover has portions which comprise a rounding between the leading edge or the trailing edge of the openings and the wear surface.

8. The apparatus of claim 1 wherein the wear surface has a hard coating.

9. The apparatus of claim 1 wherein the vacuum equipment includes fittings for fastening the cover to T rails on the fiber web machine.

10. A suction box in a fiber web machine, wherein a fabric is arranged movable over the suction box to define a machine direction, comprising:

a frame mounted to the fiber web machine, the frame having an interior connected to a source of vacuum;

a cover mounted to the frame, the cover separating the fabric from the frame interior forming the source of vacuum, the cover having a wear surface and having portions defining a plurality of openings, said openings being defined by opposite edges, the opposite edges defining a distance x in the machine direction therebetween, the openings in the cover for extending a vacuum effect from the interior;

a fabric included in the fiber web machine and set in contact with the cover wear surface so that the vacuum effect is applied to the fabric; and wherein the cover is formed from sheet metal having a thickness s between the fabric and the frame interior forming the source of vacuum which is less than or equal to the distance x.

11. The apparatus of claim 10 wherein the sheet metal has a thickness of 2-10 mm.

12. The apparatus of claim 10 wherein the sheet metal has a thickness of 4- 6 mm.

13. The apparatus of claim 10 wherein the distance x is 10-25 mm.

14. The apparatus of claim 10 wherein the cover defines a leading edge and a trailing edge with respect to movement of the fabric over the cover, and wherein the plate construction includes at least one bend at the leading edge or at the trailing edge.

15. The apparatus of claim 10 wherein the cover has a concave portion defining a centerline which extends in a cross direction with respect to movement of the fabric over the cover.

16. The apparatus of claim 10 wherein the openings define a leading edge of the openings and a trailing edge of the openings with respect to movement of the fabric over the cover and wherein the cover has portions which comprise a rounding between the leading edge or the trailing edge of the openings and the wear surface.

17. The apparatus of claim 10 wherein the wear surface has a hard coating.

18. The apparatus of claim 10 wherein the vacuum equipment includes fittings for fastening the cover to T rails on the fiber web machine.

19. A suction box in a fiber web machine comprising:

a frame arranged to be supported on the fiber web machine, the frame having an interior forming a source of vacuum;

a fabric mounted for motion in a machine direction on the fiber web machine so the fabric is movable along a fabric path, the fabric path defining a machine direction;

a cover, the cover separating the fabric from the frame interior forming the source of vacuum, wherein the cover is formed of sheet metal 2-10 mm thick mounted to the frame, the cover having a wear surface and having portions defining a plurality of openings, said openings being defined by opposite edges, the opposite edges defining a distance in the machine direction of 10-25 mm therebetween, the openings in the cover for extending a vacuum effect from the interior;

wherein the cover extends with respect to the fabric in a cross direction perpendicular to the machine direction, and the fabric path over the cover is defined with respect to movement of the fabric over the cover in the machine direction;

wherein the cover includes a first bend at a leading edge which is upstream in the machine direction so the fabric first engages the leading edge and a second bend at a trailing edge which is downstream in the machine direction so the fabric last engages the trailing edge, the first bend and the second bend in the sheet metal to form an upside down U-shape which extends with respect to the fabric in the cross direction; and wherein the fabric is in contact with the cover wear surface which forms the top of the upside down U-shape.

20. The apparatus of claim 19 wherein the cover between the leading edge and the trailing edge has a concave portion defining a centerline which extends in a cross direction with respect to movement of the fabric over the cover, the concave portion having a cross direction center line positioned beneath the fabric;

wherein the wear surface is coated with a smooth and resistant hard coating which is ceramic or cera-metallic with a surface roughness Ra of less than 0.5μm;

wherein the plurality of openings are arranged in the concave portion and the fabric has a tension such that the leading and trailing edges receive the highest wear; and wherein the concave portion forms a pan-like construction overlain by the fabric so as to reduce suction losses caused by leaks.

* * * * *